US010310530B1

(12) United States Patent
Lu et al.

(10) Patent No.: US 10,310,530 B1
(45) Date of Patent: Jun. 4, 2019

(54) LOW-DROPOUT REGULATOR WITH LOAD-ADAPTIVE FREQUENCY COMPENSATION

(71) Applicant: TEXAS INSTRUMENTS INCORPORATED, Dallas, TX (US)

(72) Inventors: Feng Lu, Shanghai (CN); Qingjie Ma, Shanghai (CN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 15/963,330

(22) Filed: Apr. 26, 2018

Related U.S. Application Data

(63) Continuation of application No. PCT/CN2017/118312, filed on Dec. 25, 2017.

(51) Int. Cl.

| | |
|---|---|
| ***G05F 1/575*** | (2006.01) |
| ***G05F 3/26*** | (2006.01) |
| ***G05F 1/46*** | (2006.01) |
| ***G05F 1/59*** | (2006.01) |

(52) U.S. Cl.
CPC ..... *G05F 1/575* (2013.01); *G05F 1/468* (2013.01); *G05F 1/59* (2013.01)

(58) Field of Classification Search
CPC ..... G05F 1/46; G05F 1/461; G05F 1/468; G05F 1/56; G05F 1/575; G05F 1/59; G05F 3/26; G05F 3/262; G05F 3/265; G05F 3/267; G05F 3/30
See application file for complete search history.

(56) References Cited

U.S. PATENT DOCUMENTS 5,146,152 A * 9/1992 Jin ..... G05F 1/465 323/280
5,563,501 A * 10/1996 Chan ..... G05F 1/565 323/273
6,300,749 B1 10/2001 Castelli et al.
(Continued)

FOREIGN PATENT DOCUMENTS

CN 102913060 A 2/2013

OTHER PUBLICATIONS

Search Report for PCT Application No. PCT/CN2017/118312, date of mailing of the international search report, Sep. 25, 2018 (2 pages).

*Primary Examiner* — Adolf D Berhane
(74) *Attorney, Agent, or Firm* — Tuenlap Chan; Charles A. Brill; Frank D. Cimino

(57) ABSTRACT

A circuit comprises: a pass transistor; a first transistor comprising a gate coupled to the gate of the pass transistor, a source coupled to the source of the pass transistor, and a drain; a second transistor comprising a gate coupled to the gate of the pass transistor, a source coupled to the source of the pass transistor, and a drain; a first current mirror coupled to the drain of the first transistor; a second current mirror coupled to the drain of the second transistor, and coupled to the first current mirror; a feedback voltage circuit coupled to the drain of the pass transistor; an error amplifier comprising a first input port coupled to the feedback voltage circuit, and an output port coupled to the gate of the pass transistor; and a capacitor coupled to the second current mirror and to the first input port of the error amplifier.

20 Claims, 2 Drawing Sheets

(56) References Cited

U.S. PATENT DOCUMENTS

| | | | | |
|---|---|---|---|---|
| 6,765,374 | B1 * | 7/2004 | Yang | G05F 1/575 323/280 |
| 7,129,686 | B1 * | 10/2006 | Huang | G05F 1/575 323/313 |
| 2007/0063736 | A1 | 3/2007 | Biagi | |
| 2008/0169795 | A1 * | 7/2008 | Wang | G05F 1/575 323/280 |
| 2013/0120891 | A1 | 5/2013 | Truong et al. | |
| 2015/0061622 | A1 * | 3/2015 | Bhattad | G05F 1/56 323/280 |
| 2016/0352298 | A1 * | 12/2016 | Lin | H03F 1/0205 |
| 2017/0205841 | A1 * | 7/2017 | Jefremow | G05F 1/575 |
| 2017/0220058 | A1 * | 8/2017 | Petenyi | G05F 1/575 |
| 2018/0196454 | A1 * | 7/2018 | Ivanov | G05F 1/575 |
| 2018/0217623 | A1 * | 8/2018 | Bhattad | G05F 1/595 |

* cited by examiner

LOW-DROPOUT REGULATOR WITH LOAD-ADAPTIVE FREQUENCY COMPENSATION

BACKGROUND

A low-dropout (LDO) regulator provides a regulated direct current (DC) output voltage to a load. An LDO regulator usually includes a pass transistor regulating load current to a load, and a feedback loop controlling the pass transistor to regulate the output voltage provided to the load. Stability of the LDO regulator over a wide range of load conditions is one of the design goals.

SUMMARY

In accordance with a first set of implementations of the present disclosure, a circuit comprises: a pass transistor comprising a gate, a source, and a drain; a first transistor comprising a gate coupled to the gate of the pass transistor, a source coupled to the source of the pass transistor, and a drain; a second transistor comprising a gate coupled to the gate of the pass transistor, a source coupled to the source of the pass transistor, and a drain; a first current mirror coupled to the drain of the first transistor; a second current mirror coupled to the drain of the second transistor, and coupled to the first current mirror; a feedback voltage circuit coupled to the drain of the pass transistor; an error amplifier comprising a first input port coupled to the feedback voltage circuit, a second input port, and an output port coupled to the gate of the pass transistor; and a capacitor coupled to the second current mirror and to the first input port of the error amplifier.

In accordance with the first set of implementations of the present disclosure, the circuit further comprises an output capacitor coupled to the drain of the pass transistor.

In accordance with the first set of implementations of the present disclosure, the circuit further comprises: an input port coupled to the source of the pass transistor; an output port coupled to the drain of the pass transistor; and a reference voltage input port coupled to the second input port of the error amplifier.

In accordance with the first set of implementations of the present disclosure, in the circuit, the pass transistor, the first transistor, and the second transistors are each p-metal-oxide-semiconductor field-effect transistors.

In accordance with the first set of implementations of the present disclosure, in the circuit, the first current mirror comprises: a third transistor comprising a drain coupled to the drain of the first transistor, a gate connected to the drain of the third transistor, and a source; and a fourth transistor comprising a gate connected to the gate of the third transistor, a source connected to the source of the third transistor, and a drain.

In accordance with the first set of implementations of the present disclosure, in the circuit, the second current mirror comprises: a fifth transistor comprising a drain connected to the drain of the fourth transistor, a source connected to the drain of the second transistor, and a gate connected to the drain of the fifth transistor; and a sixth transistor comprising a gate connected to the gate of the fifth transistor, a source connected to the source of the fifth transistor, and a drain coupled to the feedback voltage circuit.

In accordance with the first set of implementations of the present disclosure, in the circuit, the capacitor comprises a first terminal connected to the source of the fifth transistor, and a second terminal coupled to the first input port of the error amplifier.

In accordance with the first set of implementations of the present disclosure, in the circuit, the feedback voltage circuit comprises: a first resistor comprising a first terminal connected to the drain of the pass transistor, and a second terminal connected to the second terminal of the capacitor; and a second resistor comprising a first terminal connected to the second terminal of the first resistor, and a second terminal.

In accordance with the first set of implementations of the present disclosure, the circuit further comprises an output capacitor coupled to the drain of the pass transistor.

In accordance with the first set of implementations of the present disclosure, in the circuit: the pass transistor, the first transistor, the second transistor, the fifth transistor, and the sixth transistor are each p-metal-oxide-semiconductor field-effect transistors; and the third transistor and the fourth transistor are each n-metal-oxide-semiconductor field-effect transistors.

In accordance with the first set of implementations of the present disclosure, the circuit further comprises a ground connected to the source of the third transistor, and to the second terminal of the second resistor.

In accordance with the first set of implementations of the present disclosure, the circuit further comprises: a reference voltage source connected to second input port of the error amplifier; and an input voltage source connected to the source of the pass transistor.

In accordance with a second set of implementations of the present disclosure, a circuit comprises: a pass transistor comprising a gate, a source, and a drain; a first transistor comprising a gate connected to the gate of the pass transistor, a source connected to the source of the pass transistor, and a drain; a second transistor comprising a gate connected to the gate of the pass transistor, a source connected to the source of the pass transistor, and a drain; an error amplifier comprising a first input port, a second input port, and an output port coupled to the gate of the pass transistor; a third transistor comprising a drain connected to the drain of the first transistor, a gate connected to the drain of the third transistor, and a source; a fourth transistor comprising a gate connected to the gate of the third transistor, a source connected to the source of the third transistor, and a drain; a fifth transistor comprising a drain connected to the drain of the fourth transistor, a source connected to the drain of the second transistor, and a gate connected to the drain of the fifth transistor; a sixth transistor comprising a gate connected to the gate of the fifth transistor, a source connected to the source of the fifth transistor, and a drain; and a capacitor having a first terminal connected to the source of the fifth transistor, and a second terminal connected to the first input port of the error amplifier.

In accordance with the second set of implementations of the present disclosure, in the circuit: the pass transistor, the second transistor, the third transistor, the fifth transistor, and the sixth transistor are each p-metal-oxide-semiconductor field-effect transistors; and the third transistor and the fourth transistor are each a n-metal-oxide-semiconductor field-effect transistors.

In accordance with the second set of implementations of the present disclosure, the circuit further comprises a buffer, the buffer comprising an input port and an output port, wherein the input port of the buffer is connected to the output port of the error amplifier, and an output port of the buffer is connected to the gate of the pass transistor.

In accordance with the second set of implementations of the present disclosure, the circuit further comprises: a first terminal connected to the drain of the pass transistor; and a second terminal connected to the first input port of the error amplifier.

In accordance with the second set of implementations of the present disclosure, the circuit further comprises a reference voltage source connected to second input port of the error amplifier.

In accordance with the second set of implementations of the present disclosure, the circuit further comprises an input voltage source connected to the source of the pass transistor.

In accordance with a third set of implementations of the present disclosure, a circuit comprises: a pass transistor to provide a pass current, the pass transistor comprising a gate, a source, and a drain; a first transistor to provide a first bias current, the first transistor comprising a gate connected to the gate of the pass transistor, a source connected to the source of the pass transistor, and a drain; a second transistor to provide a second bias current, the second transistor comprising a gate connected to the gate of the pass transistor, a source connected to the source of the pass transistor, and a drain; an error amplifier comprising a first input port, a second input port, and an output port coupled to the gate of the pass transistor to modulate the pass current; a first mirror current comprising a third transistor and a fourth transistor, the third transistor to have a source-drain current provided by the first bias current; a second mirror current comprising a fifth transistor and a sixth transistor, the fifth and fourth transistors to have equal source-drain currents, the sixth transistor comprising a source connected to the drain of the second transistor, and a drain connected to the drain of the pass transistor; and a capacitor comprising a first terminal connected to the drain of the second transistor, and a first terminal connected to the first input port of the error amplifier.

In accordance with the third set of implementations of the present disclosure, the circuit further comprises a voltage divider connected to the drain of the pass transistor, the voltage divider connected to the error amplifier to provide a feedback voltage at the first input port of the error amplifier.

BRIEF DESCRIPTION OF THE DRAWINGS

For a detailed description of various examples, reference will now be made to the accompanying drawings in which.

DETAILED DESCRIPTION

Many LDO regulators include a pass transistor and an error amplifier to control the pass transistor. To provide a regulated DC voltage to a load, an input voltage source is coupled to an input port of the LDO regulator, and an output capacitor and a voltage divider circuit are coupled to an output port of the LDO regulator. The voltage divider circuit provides a feedback voltage to the error amplifier. The error amplifier adjusts the gate voltage of the pass transistor based upon comparing the feedback voltage to a reference voltage. The voltage divider circuit may be a resistor divider circuit, provided by a user of the LDO regulator. The user may provide the output capacitor and the reference voltage. An output capacitor has a parasitic resistance, referred to as an equivalent series resistance. An LDO regulator is designed with sufficient phase margin to maintain stability over a wide load range, a wide range of capacitance for the output capacitor, and a wide range of equivalent series resistance for the output capacitor.

In accordance with the disclosed embodiments, a LDO regulator includes a pass transistor, a first transistor, and a second transistor coupled together so that their respective gates are connected together, and their respective sources are connected together. A first current mirror is coupled to the drain of the first transistor, and a second current mirror is coupled to the drain of the second transistor. The first current mirror is coupled to the second current mirror. A feedback voltage circuit is coupled to the drain of the pass transistor to provide a feedback voltage to a first input port of an error amplifier. A compensation capacitor is coupled to the second current mirror and to the first input port of the error amplifier. In accordance with disclosed embodiments, a reference voltage source is coupled to a second input port of the error amplifier, and an input voltage source is coupled to the source of the pass transistor.

As will be discussed further, the compensation capacitor, the first and second transistors, and the first and second current mirrors compensate for poles in the feedback transfer function of the LDO regulator to help ensure stability over a wide load range, a wide range of capacitance for the output capacitor, and a wide range of equivalent series resistance for the output capacitor.

Figure 1:
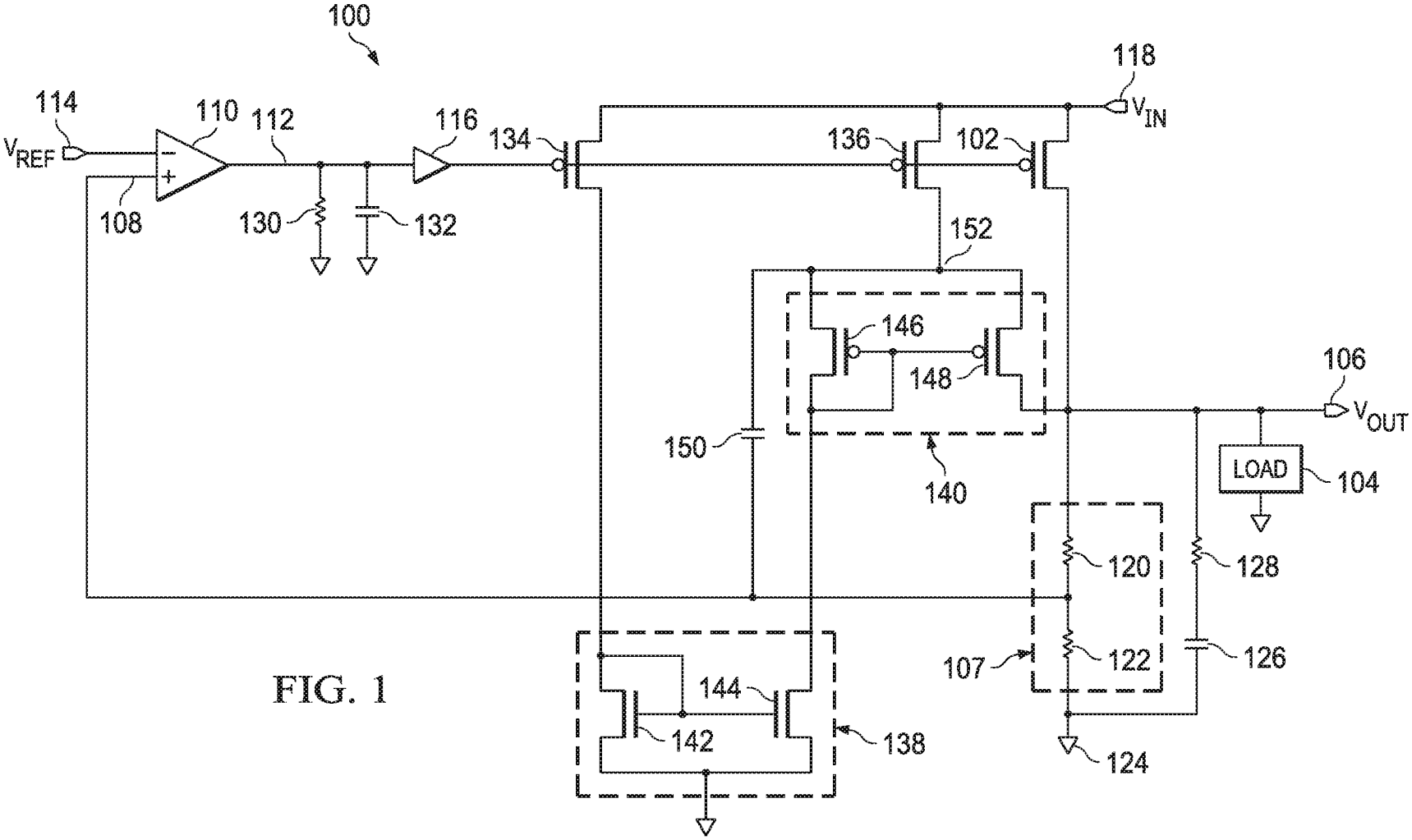
FIG. 1 shows an LDO regulator in accordance with various examples.

FIG. 1 shows an illustrative LDO regulator 100. A pass transistor 102 provides a source-drain current to a load 104 coupled to an output port 106. The source-drain current of the pass transistor 102 may be referred to as a pass current. In the embodiment of FIG. 1, the pass transistor 102 is a p-metal-oxide-semiconductor field-effect transistor (pMOSFET).

The source-drain current of the pass transistor 102 provides a load current to the load 104 and current to a feedback voltage circuit 107. The feedback voltage circuit 107 develops a feedback voltage provided to an input port 108 of an error amplifier 110. The error amplifier 110 provides an output voltage at an output port 112 in response to the difference (error) of the feedback voltage and a reference voltage at an input port 114. The output port 112 of the error amplifier 110 is coupled to the gate of the pass transistor 102 by way of a buffer 116. In some embodiments, the buffer 116 may be included within the error amplifier 110.

An input voltage source (not shown in FIG. 1) provides an input voltage at an input port 118. The source of the pass transistor 102 is connected to the input port 118, and the drain of the pass transistor 102 is connected to the output port 106. The error amplifier 110 adjusts the gate voltage of the pass transistor 102 so that the voltage drop across the pass transistor 102 is regulated to maintain a desired output voltage at the output port 106, determined by the feedback voltage circuit 107 and the reference voltage at the input port 114 of the error amplifier 110.

In the embodiment illustrated in FIG. 1, the feedback voltage circuit 107 comprises a resistor 120 connected in series with a resistor 122, with a terminal of the resistor 120 connected to the output port 106, and a terminal of the resistor 122 connected to a ground (substrate) 124. An output capacitor 126 has a terminal connected to the output port 106 and a terminal connected to the ground 124. A resistor 128 illustrates a parasitic resistance (i.e., it is not a separate circuit element), and represents an equivalent series resistance of the output capacitor 126. A resistor 130 and a capacitor 132 represent, respectively, a parasitic resistance and a parasitic capacitance.

A pMOSFET 134 and a pMOSFET 136 each have their sources connected to the input port 118 and their gates connected to the gate of the pass transistor 102. The drain of the pMOSFET 134 is connected to a current mirror 138. The source-drain current of the pMOSFET 134, which may be referred to as a bias current, is fed into the current mirror 138. The drain of the pMOSFET 136 is connected to a current mirror 140. The source-drain current of the pMOSFET 136, which may be referred to as a bias current, is fed into the current mirror 140.

The current mirror 138 comprises an n-metal-oxide-semiconductor field-effect transistor (nMOSFET) 142 with its gate connected to its drain, where the drain of the pMOSFET 134 is connected to the drain of the nMOSFET 142. The current mirror 138 comprises an nMOSFET 144 with its gate connected to the gate of the nMOSFET 142, and its source connected to the source of the nMOSFET 142. The sources of the nMOSFETs 142 and 144 are connected to the ground 124.

The current mirror 140 comprises a pMOSFET 146 with its gate connected to its drain. The drain of the pMOSFET 146 is connected to the drain of the nMOSFET 144. The current mirror 140 comprises a pMOSFET 148 with its gate connected to the gate of the pMOSFET 146, and its source connected to the source of the pMOSFET 146. The sources of the pMOSFETs 146 and 148 are connected to the drain of the pMOSFET 136. The drain of the pMOSFET 148 is connected to the output port 106.

A capacitor 150 has a terminal connected to the sources of the pMOSFETs 146 and 148, and a terminal connected to the input port 108 of the error amplifier 110. The capacitor 150 may be referred to as a compensation capacitor 150.

The combination of the compensation capacitor 150, the pMOSFET 148, and the pMOSFET 136 generates a compensation zero at a node 152. The combination of the pMOSFET 134, the nMOSFET 142, the nMOSFET 144, and the pMOSFET 146 generates a load-adaptive function. These characteristics allow the illustrative LDO regulator 100 to support a wide range of loads, a wide output capacitance range, and a wide range of equivalent series resistance for the output capacitor 126.

The source-drain current of the pMOSFET 134 is a bias current provided to the current mirror 138, and the source-drain current of the pMOSFET 136 is a bias current provided to the current mirror 140. These bias currents are each proportional to the source-drain (pass current) of the pass transistor 102, where the respective proportionality constants depend upon the relative sizes of the pMOSFETs 134 and 136 to the pass transistor 102. With most of the source-drain current of the pass transistor 102 provided as load current to the load 104, the bias currents of the pMOSFETs 134 and 136 are essentially proportional to load current.

The nMOSFET 142 mirrors the bias current provided by pMOSFET 134 to the nMOSFET 144. For embodiments in which the size of the pMOSFET 148 is substantially larger than the size of the pMOSFET 146 (e.g., a ratio of about seven as a particular example), the pMOSFET 148 operates in a linear region, and most of the bias current provided by the pMOSFET 136 flows through the pMOSFET 148.

A zero generated at the node 152, denoted as $Z_C$, can be expressed as:

$$Z_C=1/[(R_{ESR}+(1/g_M)(1/K))C_{OUT}],$$

where $R_{ESR}$ is the equivalent series resistance of the output capacitor 126, $g_M$ is the transconductance of the pMOSFET 148, K is the size ratio of the pass transistor 102 to the pMOSFET 136, and $C_{OUT}$ is the capacitance of the output capacitor 126.

A pole generated at the output port 106, denoted as $P_0$, can be expressed as:

$$P_0=1/(R_L C_{OUT}),$$

where $R_L$ is the equivalent resistance at the output port 106.

A zero generated at the output port 106, denoted as $Z_1$, can be expressed as:

$$Z_1=1/(R_{ESR}C_{OUT}).$$

If the LDO regulator 100 is designed to satisfy $$Z_C > \frac{1}{R_{F1}C_C},$$

where $R_{F1}$ is the resistance of the resistor 120 and $C_C$ is the capacitance of the compensation capacitor 150, and if the LDO regulator 100 is designed to satisfy $$R_{ESR} < \frac{1}{g_M K},$$

then the open loop gain for the LDO regulator 100, denoted as A(s), can be approximated as $$A(s) = \frac{R_{F2}}{R_{F1}+R_{F2}} g_{EA} R_P \frac{1}{1+sR_P C_P} g_{MP} R_L \frac{1+sC_{OUT}/(g_M K)}{1+sR_L C_{OUT}}.$$

In the above expression for A(s), $g_{EA}$ is the transconductance of the error amplifier 110, $R_{F2}$ is the resistance of the resistor 122, $R_P$ is the parasitic resistance represented by the resistor 130, $C_P$ is the parasitic capacitance represented by the capacitor 132, and $g_{MP}$ is the transconductance of the pass transistor 102.

Inspection of the above expression for the open loop gain A(s) shows that the open loop gain is insensitive to $R_L$ and $C_{OUT}$. Furthermore, the transconductances $g_M$ and $g_{MP}$ are proportional to the source-drain current of the pass transistor 102, but because $g_{MP}$ is in the numerator and $g_M$ is in the denominator, the open loop gain is insensitive to load current. As a result, the open loop gain is insensitive to the output capacitor 126 and the load current provided to the load 104. The LDO regulator 100 can be designed to be load-adaptive, with stability over a wide load current provided to the load 104, a wide range of capacitance for the output capacitor 126, and a wide range of equivalent series resistance for the output capacitor 126.

The size ratio of the pass transistor 102 to the pMOSFET 136 may or may not be equal to the size ratio of the pass transistor 102 to the pMOSFET 134. For some embodiments, these size ratios may be from 1,000 to 2,000, although other ranges of size ratios may be employed. For some embodiments, the size ratio of the nMOSFET 142 to the nMOSFET 144 may be on the order of one to ten, for example about five, but other size ratios may be used. The size ratio of the pMOSFET 148 to the pMOSFET 146 may be on the order of one to ten, for example about seven, but other sizes may be used.

Figure 2:
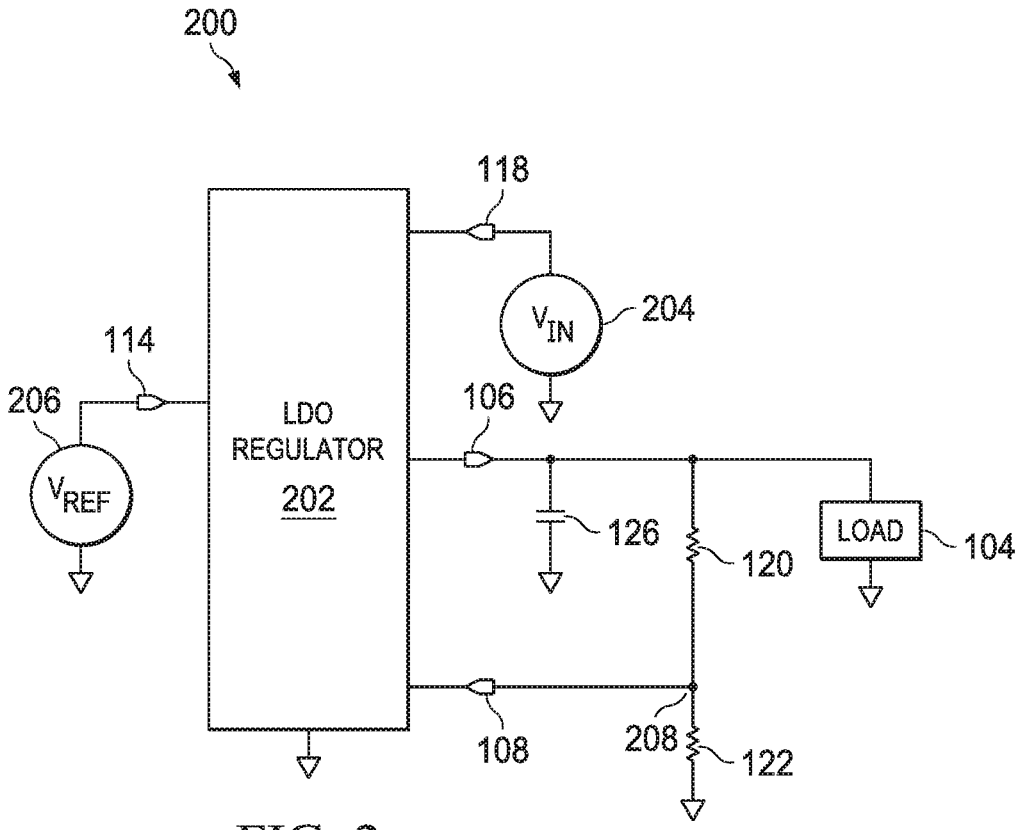
FIG. 2 shows a system with an LDO regulator and voltage sources in accordance with various examples.

FIG. 2 shows an illustrative system 200 with an LDO regulator 202 and voltage sources. An input voltage source 204 provides an input voltage (or supply voltage) to the input port 118, and a reference voltage source 206 provides a reference voltage to the input port 114. In the embodiment of FIG. 2, the LDO regulator 202 includes much of the components illustrated in FIG. 1, but where the feedback voltage circuit 107 (comprising the resistors 120 and 122 in FIG. 2) is external to the LDO regulator 202. The feedback voltage generated at a node 208 is provided to the input port 108. The output capacitor 126 and the load 104 are external to the LDO regulator 202, and are coupled to the output port 106.

The components within the LDO regulator 202 may be integrated on a single die. In other embodiments, the pass transistor 102 (illustrated in FIG. 1) could be external to the LDO regulator 202, although in the particular embodiment of FIG. 2 the pass transistor 102 is included in the LDO regulator 202 with other circuit components. Similarly, the compensation capacitor 150 could be external to the LDO regulator 202, although in the particular embodiment of FIG. 2 the compensation capacitor 150 is included in the LDO regulator 202 with other circuit components. For some embodiments, the reference voltage source 206 could be included in the LDO regulator 202. The LDO regulator 202 may include other ports (not shown in FIG. 2) to provide connections to other external components to provide additional features.

Embodiments, such as the illustrative circuit 100 of FIG. 1, include several functional blocks (circuits), where a functional block may comprise one or more circuit components. As an example, in the illustrative circuit 100 of FIG. 1, a first circuit is configured to receive a reference voltage and a feedback voltage to control a pass transistor (e.g., the pass transistor 102). In the particular example provided by FIG. 1, the first circuit comprises the error amplifier 110 and the buffer 116.

Continuing with the above functional description, a second circuit generates a compensation zero at a node, where the node is coupled to the first circuit. As described previously, the combination of the compensation capacitor 150, the pMOSFET 148, and the pMOSFET 136 generates a compensation zero at the node 152. Accordingly, the second circuit may be viewed as comprising these components, where the node is the node 152.

A third circuit generates a load-adaptive function. For example, as described previously, the combination of the pMOSFET 134, the nMOSFET 142, the nMOSFET 144, and the pMOSFET 146 generates a load-adaptive function. Accordingly, these components may be viewed as being included in the third circuit. A fourth circuit generates the feedback voltage. As an example, the fourth circuit comprises the resistors 120 and 122.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A circuit comprising:

a pass transistor comprising a gate, a source, and a drain;

a first transistor comprising a gate coupled to the gate of the pass transistor, a source coupled to the source of the pass transistor, and a drain;

a second transistor comprising a gate coupled to the gate of the pass transistor, a source coupled to the source of the pass transistor, and a drain;

a first current mirror coupled to the drain of the first transistor;

a second current mirror coupled to the drain of the second transistor, and coupled to the first current mirror;

a feedback voltage circuit coupled to the drain of the pass transistor;

an error amplifier comprising a first input port coupled to the feedback voltage circuit, a second input port, and an output port coupled to the gate of the pass transistor; and a capacitor coupled to the second current mirror and to the first input port of the error amplifier.

2. The circuit of claim 1, further comprising an output capacitor coupled to the drain of the pass transistor.

3. The circuit of claim 1, further comprising:

an input port coupled to the source of the pass transistor;

an output port coupled to the drain of the pass transistor; and a reference voltage input port coupled to the second input port of the error amplifier.

4. The circuit of claim 1, wherein the pass transistor, the first transistor, and the second transistors are each p-metal-oxide-semiconductor field-effect transistors.

5. The circuit of claim 1, wherein the first current mirror comprises:

a third transistor comprising a drain coupled to the drain of the first transistor, a gate connected to the drain of the third transistor, and a source; and a fourth transistor comprising a gate connected to the gate of the third transistor, a source connected to the source of the third transistor, and a drain.

6. The circuit of claim 5, wherein the second current mirror comprises:

a fifth transistor comprising a drain connected to the drain of the fourth transistor, a source connected to the drain of the second transistor, and a gate connected to the drain of the fifth transistor; and a sixth transistor comprising a gate connected to the gate of the fifth transistor, a source connected to the source of the fifth transistor, and a drain coupled to the feedback voltage circuit.

7. The circuit of claim 6, wherein the capacitor comprises a first terminal connected to the source of the fifth transistor, and a second terminal coupled to the first input port of the error amplifier.

8. The circuit of claim 7, wherein the feedback voltage circuit comprises:

a first resistor comprising a first terminal connected to the drain of the pass transistor, and a second terminal connected to the second terminal of the capacitor; and a second resistor comprising a first terminal connected to the second terminal of the first resistor, and a second terminal.

9. The circuit of claim 8, further comprising an output capacitor coupled to the drain of the pass transistor.

10. The circuit of claim 9, wherein the pass transistor, the first transistor, the second transistor, the fifth transistor, and the sixth transistor are each p-metal-oxide-semiconductor field-effect transistors; and the third transistor and the fourth transistor are each n-metal-oxide-semiconductor field-effect transistors.

11. The circuit of claim 10, further comprising a ground connected to the source of the third transistor, and to the second terminal of the second resistor.

12. The circuit of claim 11, further comprising:

a reference voltage source connected to second input port of the error amplifier; and an input voltage source connected to the source of the pass transistor.

13. A circuit comprising:

a pass transistor comprising a gate, a source, and a drain;

a first transistor comprising a gate connected to the gate of the pass transistor, a source connected to the source of the pass transistor, and a drain;

a second transistor comprising a gate connected to the gate of the pass transistor, a source connected to the source of the pass transistor, and a drain;

an error amplifier comprising a first input port, a second input port, and an output port coupled to the gate of the pass transistor;

a third transistor comprising a drain connected to the drain of the first transistor, a gate connected to the drain of the third transistor, and a source;

a fourth transistor comprising a gate connected to the gate of the third transistor, a source connected to the source of the third transistor, and a drain;

a fifth transistor comprising a drain connected to the drain of the fourth transistor, a source connected to the drain of the second transistor, and a gate connected to the drain of the fifth transistor;

a sixth transistor comprising a gate connected to the gate of the fifth transistor, a source connected to the source of the fifth transistor, and a drain; and a capacitor having a first terminal connected to the source of the fifth transistor, and a second terminal connected to the first input port of the error amplifier.

14. The circuit of claim 13, wherein the pass transistor, the second transistor, the third transistor, the fifth transistor, and the sixth transistor are each p-metal-oxide-semiconductor field-effect transistors; and the third transistor and the fourth transistor are each a n-metal-oxide-semiconductor field-effect transistors.

15. The circuit of claim 13, further comprising a buffer, the buffer comprising an input port and an output port, wherein the input port of the buffer is connected to the output port of the error amplifier, and an output port of the buffer is connected to the gate of the pass transistor.

16. The circuit of claim 13, further comprising a resistor, the resistor comprising:

a first terminal connected to the drain of the pass transistor; and a second terminal connected to the first input port of the error amplifier.

17. The circuit of claim 16, further comprising a reference voltage source connected to second input port of the error amplifier.

18. The circuit of claim 17, further comprising an input voltage source connected to the source of the pass transistor.

19. A circuit comprising:

a pass transistor to provide a pass current, the pass transistor comprising a gate, a source, and a drain;

a first transistor to provide a first bias current, the first transistor comprising a gate connected to the gate of the pass transistor, a source connected to the source of the pass transistor, and a drain;

a second transistor to provide a second bias current, the second transistor comprising a gate connected to the gate of the pass transistor, a source connected to the source of the pass transistor, and a drain;

an error amplifier comprising a first input port, a second input port, and an output port coupled to the gate of the pass transistor to modulate the pass current;

a first mirror current comprising a third transistor and a fourth transistor, the third transistor to have a source-drain current provided by the first bias current;

a second mirror current comprising a fifth transistor and a sixth transistor, the fifth and fourth transistors to have equal source-drain currents, the sixth transistor comprising a source connected to the drain of the second transistor, and a drain connected to the drain of the pass transistor; and a capacitor comprising a first terminal connected to the drain of the second transistor, and a first terminal connected to the first input port of the error amplifier.

20. The circuit of claim 19, further comprising:

a voltage divider connected to the drain of the pass transistor, the voltage divider connected to the error amplifier to provide a feedback voltage at the first input port of the error amplifier.

* * * * *